US010874147B2

(12) United States Patent
Qiu

(10) Patent No.: US 10,874,147 B2
(45) Date of Patent: Dec. 29, 2020

(54) ATOMIZER AND ELECTRONIC CIGARETTE HAVING SAME

(71) Applicant: CHANGZHOU JWEI INTELLIGENT TECHNOLOGY CO., LTD., Changzhou (CN)

(72) Inventor: Weihua Qiu, Changzhou (CN)

(73) Assignee: CHANGZHOU JWEI INTELLIGENT TECHNOLOGY CO., LTD., Changzhou (CN)

( * ) Notice: Subject to any disclaimer, the term of this patent is extended or adjusted under 35 U.S.C. 154(b) by 365 days.

(21) Appl. No.: 16/068,362

(22) PCT Filed: Oct. 13, 2016

(86) PCT No.: PCT/CN2016/101977
§ 371 (c)(1),
(2) Date: Jul. 5, 2018

(87) PCT Pub. No.: WO2017/118135
PCT Pub. Date: Jul. 13, 2017

(65) Prior Publication Data

US 2019/0021398 A1 Jan. 24, 2019

(30) Foreign Application Priority Data

Jan. 6, 2016 (CN) ..... 2016 2 0005260 U

(51) Int. Cl.
*A24F 47/00* (2020.01)

(52) U.S. Cl.
CPC ..... *A24F 47/008* (2013.01); *A24F 47/00* (2013.01)

(58) Field of Classification Search
CPC ..... A24F 47/008
See application file for complete search history.

(56) References Cited

U.S. PATENT DOCUMENTS

D861,978 S * 10/2019 Lai ..... D27/167
D865,278 S * 10/2019 Chen ..... D27/167
2014/0246018 A1 9/2014 Terry et al.
2019/0021398 A1* 1/2019 Qiu ..... A24F 47/00

FOREIGN PATENT DOCUMENTS

| | | | |
|---|---|---|---|
| CN | 204157654 | U | 2/2015 |
| CN | 204635088 | U | 9/2015 |
| CN | 204763433 | U | 11/2015 |
| CN | 105192893 | A | 12/2015 |
| CN | 204812051 | U | 12/2015 |
| CN | 205358220 | U | 7/2016 |

* cited by examiner

*Primary Examiner* — James Harvey
(74) *Attorney, Agent, or Firm* — Cheng-Ju Chiang

(57) ABSTRACT

An atomizer includes a liquid storage assembly, an air adjusting assembly and a liquid adjusting assembly. The air adjusting assembly includes an air adjusting ring and an air adjusting seat. The liquid adjusting assembly includes a liquid adjusting seat, an inner sleeve pipe and a liquid barrier ring. When the air adjusting ring is rotated, an area of the air intaking hole communicated with the air intaking slot is adjusted. When the liquid adjusting seat is rotated, the liquid barrier ring is brought to rotate by the inner sleeve pipe, to cause the first liquid intaking hole and the second liquid intaking hole to be communicated with each other or staggered from each other. An electronic cigarette having the atomizer is also provided.

20 Claims, 6 Drawing Sheets

ATOMIZER AND ELECTRONIC CIGARETTE HAVING SAME

CROSS REFERENCE TO RELATED APPLICATION

This application is a 35 U.S.C. § 371 National Phase conversion of International (PCT) Patent Application No. PCT/CN2016/101977, filed on Oct. 13, 2016, which claims the priority of Chinese Patent Application No. 201620005260.2, filed on Jan. 6, 2016. The contents of the above-identified applications are incorporated herein by reference. The PCT International Patent Application was filed and published in Chinese.

TECHNICAL FIELD

The present application relates to electronic cigarettes, and more particularly to an atomizer and an electronic cigarette having the atomizer.

BACKGROUND

Electronic cigarettes have become a relatively matured substitute for smoking currently on the market. When a heating element is energized by battery, the cigarette liquid absorbed on a liquid guide element is heated by the heating element to generate smoke, such that the user gets the smoking experience.

In the existing electronic cigarettes, the air adjusting assembly and the liquid adjusting assembly are generally disposed at two opposite ends of the atomizer, respectively, which brings inconvenience for the user to operate. Also, the structures of the atomizer and the electronic cigarette are relatively complicated, and the assembling is relatively difficult.

SUMMARY

In view of the existing problems, it is necessary to provide an atomizer and an electronic cigarette having the atomizer. The structure is simple, the design is rational, and the air adjusting assembly and the liquid adjusting assembly are disposed at the same end of the atomizer, to facilitate the user to operate.

In order to realize the above-mentioned object, the technical solution of the present application is provided as follows.

An atomizer includes a liquid storage assembly, an air adjusting assembly and a liquid adjusting assembly. The air adjusting assembly includes an air adjusting ring and an air adjusting seat disposed at one end of the air adjusting ring. The liquid adjusting assembly includes a liquid adjusting seat connecting with one end of the air adjusting seat opposite to the air adjusting ring, an inner sleeve pipe connecting with one end of the liquid adjusting seat opposite to the air adjusting seat, and a liquid barrier ring connecting with one end of the inner sleeve pipe opposite to the liquid adjusting seat. The liquid barrier ring is embedded in one end of the liquid storage assembly where is defined with at least one second liquid intaking hole. The air adjusting ring is defined with at least one air intaking hole. The air adjusting seat is defined with at least one air intaking slot corresponding to the air intaking hole. When the air adjusting ring is rotated, an area of the air intaking hole communicated with the air intaking slot is adjusted. The liquid barrier ring is defined with at least one first liquid intaking hole corresponding to the second liquid intaking hole. When the liquid adjusting seat is rotated, the liquid barrier ring is brought to rotate by the inner sleeve pipe, to cause the first liquid intaking hole and the second liquid intaking hole to be communicated with each other or staggered from each other.

Further, the liquid adjusting seat is defined with at least one first liquid injecting hole communicated with the liquid storage assembly.

Further, the liquid storage assembly includes a connecting member sleeved on a top end of the inner sleeve pipe and disposed at a bottom end of the liquid adjusting seat. The connecting member is defined with at least one second liquid injecting hole. When the liquid adjusting seat is rotated, the first liquid injecting hole and the second liquid injecting hole are caused to be aligned and communicated with each other.

Further, the first liquid intaking hole and the second liquid intaking hole are staggered from each other when the first liquid injecting hole and the second liquid injecting hole are communicated with each other.

Further, the liquid adjusting assembly further includes a first sealing silicone pad embedded in the liquid adjusting seat and a second sealing silicone pad embedded in the connecting member.

Further, the first sealing silicone pad is defined with a third liquid injecting hole communicated with the first liquid injecting hole, and the second sealing silicone pad is defined with a fourth liquid injecting hole communicated with the second liquid injecting hole.

Further, the air adjusting assembly further includes a second sealing ring disposed between the air adjusting seat and the liquid adjusting seat.

Further, the atomizer further includes a mouthpiece assembly. The mouthpiece assembly includes a mouthpiece and a smoke discharging pipe. One end of the mouthpiece passes through the air adjusting ring and is connected with the air adjusting seat. The smoke discharging pipe is disposed below and connected with the mouthpiece.

Further, one end of the liquid adjusting seat is threadedly connected with the air adjusting seat, and the other end of the liquid adjusting seat is connected with one end of the inner sleeve pipe by an interference fit. One end of the inner sleeve pipe opposite to the liquid adjusting seat is connected with the liquid barrier ring by an interference fit.

An atomizer includes a liquid storage assembly and a liquid adjusting assembly. The liquid adjusting assembly includes a liquid adjusting seat, an inner sleeve pipe and a liquid barrier ring. The liquid adjusting seat is disposed at a top end of the liquid storage assembly. The liquid barrier ring is disposed at a bottom end of the liquid storage assembly. The inner sleeve pipe is disposed in the liquid storage assembly. A top end of the inner sleeve pipe is connected with the liquid adjusting seat, and a bottom end of the inner sleeve pipe is connected with the liquid barrier ring. The bottom end of the liquid storage assembly is defined with a second liquid intaking hole. The liquid barrier ring is defined with a first liquid intaking hole corresponding to the second liquid intaking hole. When the liquid adjusting seat is rotated, the liquid barrier ring is brought to rotate by the inner sleeve pipe, to cause the first liquid intaking hole and the second liquid intaking hole to be communicated with each other or staggered from each other.

Further, the liquid storage assembly includes a liquid storage pipe and a fixing member. The liquid storage pipe is sleeved around the inner sleeve pipe. The liquid adjusting seat is disposed at a top end of the liquid storage pipe, and the liquid barrier ring is disposed at a bottom end of the liquid storage pipe. The fixing member is disposed below the liquid barrier ring, and the fixing member is connected with the bottom end of the liquid storage pipe by an interference fit. A liquid storage chamber is defined in an annular space between the inner sleeve pipe and the liquid storage pipe. The fixing member is defined with the second liquid intaking hole.

Further, the liquid adjusting seat is defined with a first liquid injecting hole communicated with the liquid storage chamber.

Further, the liquid storage assembly further includes a connecting member. The connecting member is sleeved on the top end of the inner sleeve pipe, and the connecting member is disposed between the liquid storage pipe and the liquid adjusting seat. The connecting member is defined with a second liquid injecting hole corresponding to the first liquid injecting hole. When the liquid adjusting seat is rotated, the first liquid injecting hole and the second liquid injecting hole are caused to be aligned and communicated with each other.

Further, the first liquid intaking hole and the second liquid intaking hole are staggered from each other when the first liquid injecting hole and the second liquid injecting hole are communicated with each other.

Further, the liquid adjusting assembly further includes a first sealing silicone pad embedded in the liquid adjusting seat and a second sealing silicone pad embedded in the connecting member. The first sealing silicone pad is defined with a third liquid injecting hole communicated with the first liquid injecting hole, and the second sealing silicone pad is defined with a fourth liquid injecting hole communicated with the second liquid injecting hole.

Further, the atomizer further includes an air adjusting assembly. The air adjusting assembly includes an air adjusting seat and an air adjusting ring. The air adjusting seat is connected with one end of the liquid adjusting seat opposite to the liquid storage pipe. The air adjusting ring is disposed at one end of the air adjusting seat opposite to the liquid adjusting seat. The air adjusting ring is defined with an air intaking hole, and the air adjusting seat is defined with an air intaking slot corresponding to the air intaking hole. When the air adjusting ring is rotated, the air intaking hole and the air intaking slot are caused to be communicated with each other or staggered from each other.

Further, the atomizer further includes a mouthpiece assembly. The mouthpiece assembly includes a mouthpiece and a smoke discharging pipe. One end of the mouthpiece passes through the air adjusting ring and is connected with the air adjusting seat. The smoke discharging pipe is disposed below and connected with the mouthpiece.

Further, the atomizer further includes a bottom seat assembly, an insulating ring, a pole contact member and an atomizing head. The inner sleeve pipe is sleeved around the atomizing head. The bottom seat assembly is disposed at the bottom end of the liquid storage assembly. The insulating ring is attached to the bottom seat assembly and disposed at a bottom end of the bottom seat assembly. The pole contact member is disposed in the insulating ring. The pole contact member is electrically connected with the atomizing head.

An electronic cigarette including either one of the above atomizers.

The atomizer and the electronic cigarette of the present application have at least the following advantages, as compared with the prior art. The air adjusting assembly and the liquid adjusting assembly are disposed at the same end of the atomizer, to facilitate the operation for the user. The air adjusting assembly includes the air adjusting ring and the air adjusting seat, the air can enter into the atomizer. By rotating the air adjusting ring, the air intaking hole and the air intaking slot are communicated with each other, to open or close the air intaking passage, so that the air intaking into the atomizer can be adjusted, to control the amount of air intaking into the atomizer. The liquid adjusting assembly includes the liquid adjusting seat, the inner sleeve pipe and the liquid barrier ring, the cigarette liquid can be added into the atomizer. By rotating the liquid adjusting seat, the first liquid injecting hole and the second liquid injecting hole are communicated with each other, so that the cigarette liquid can be added into the liquid storage chamber. By rotating the liquid adjusting seat, the liquid barrier ring is brought to rotate due to the connection of the inner sleeve pipe, to cause the first liquid intaking hole and the second liquid intaking hole to be communicated with each other or staggered from each other, so that the amount of the cigarette liquid flowing into the atomizing head is adjusted, to realize liquid adjusting. The structure is simple, and the design is rational.

Description of the symbols:

| | | | |
|---|---|---|---|
| mouthpiece assembly | 1 | mouthpiece | 11 |
| smoke discharging pipe | 12 | first sealing ring | 13 |
| air adjusting assembly | 2 | air adjusting ring | 21 |
| air intaking hole | 211 | air adjusting seat | 22 |
| air intaking slot | 221 | second sealing ring | 23 |
| liquid adjusting assembly | 3 | liquid adjusting seat | 31 |
| first liquid injecting hole | 311 | inner sleeve pipe | 32 |
| liquid barrier ring | 33 | first liquid intaking hole | 331 |
| first sealing silicone pad | 34 | third liquid injecting hole | 341 |
| second sealing silicone pad | 35 | fourth liquid injecting hole | 351 |
| outer pipe | 41 | liquid storage assembly | 4 |
| liquid storage pipe | 42 | connecting member | 43 |
| second liquid injecting hole | 431 | liquid storage chamber | 432 |
| fixing member | 44 | second liquid intaking hole | 441 |
| bottom seat assembly | 5 | bottom cover | 51 |
| third sealing ring | 52 | insulating ring | 6 |
| pole contact member | 7 | atomizing head | 8 |
| air intaking passage | 9 | | |

DETAILED DESCRIPTION OF PREFERRED EMBODIMENTS

In order to easily understand the purposes, characteristics and advantages of the present application, exemplary embodiments of the present application are described in detail with reference to the accompanying drawings.

Figure 1:
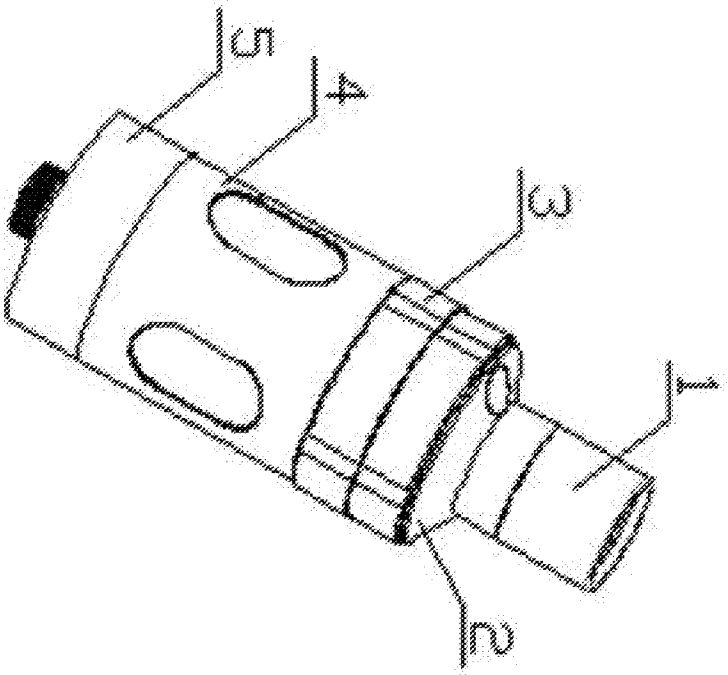
FIG. 1 is an isometric view of an atomizer according to an embodiment of the present application.
Figure 2:
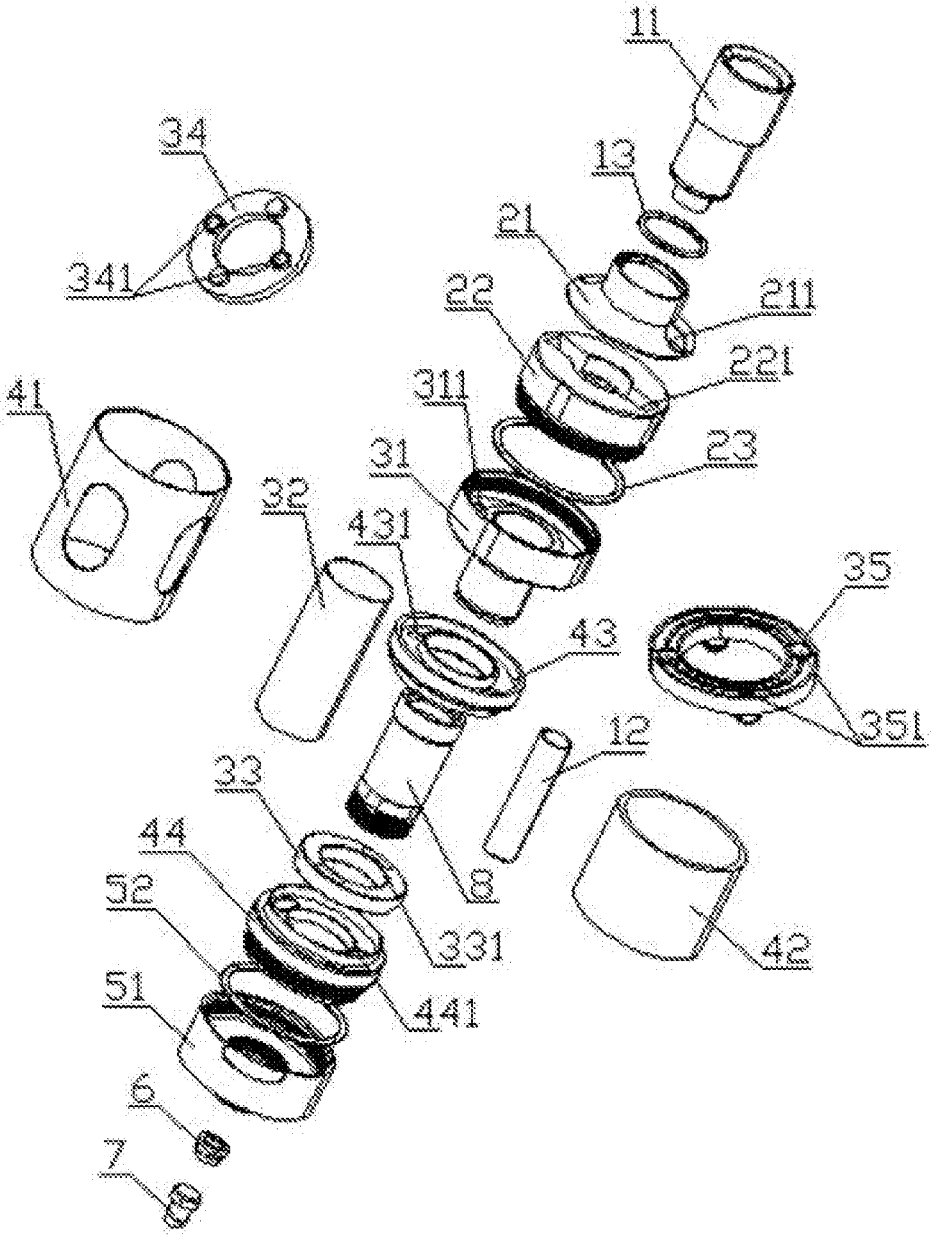
FIG. 2 is an exploded view of the atomizer of FIG. 1.
Figure 3:
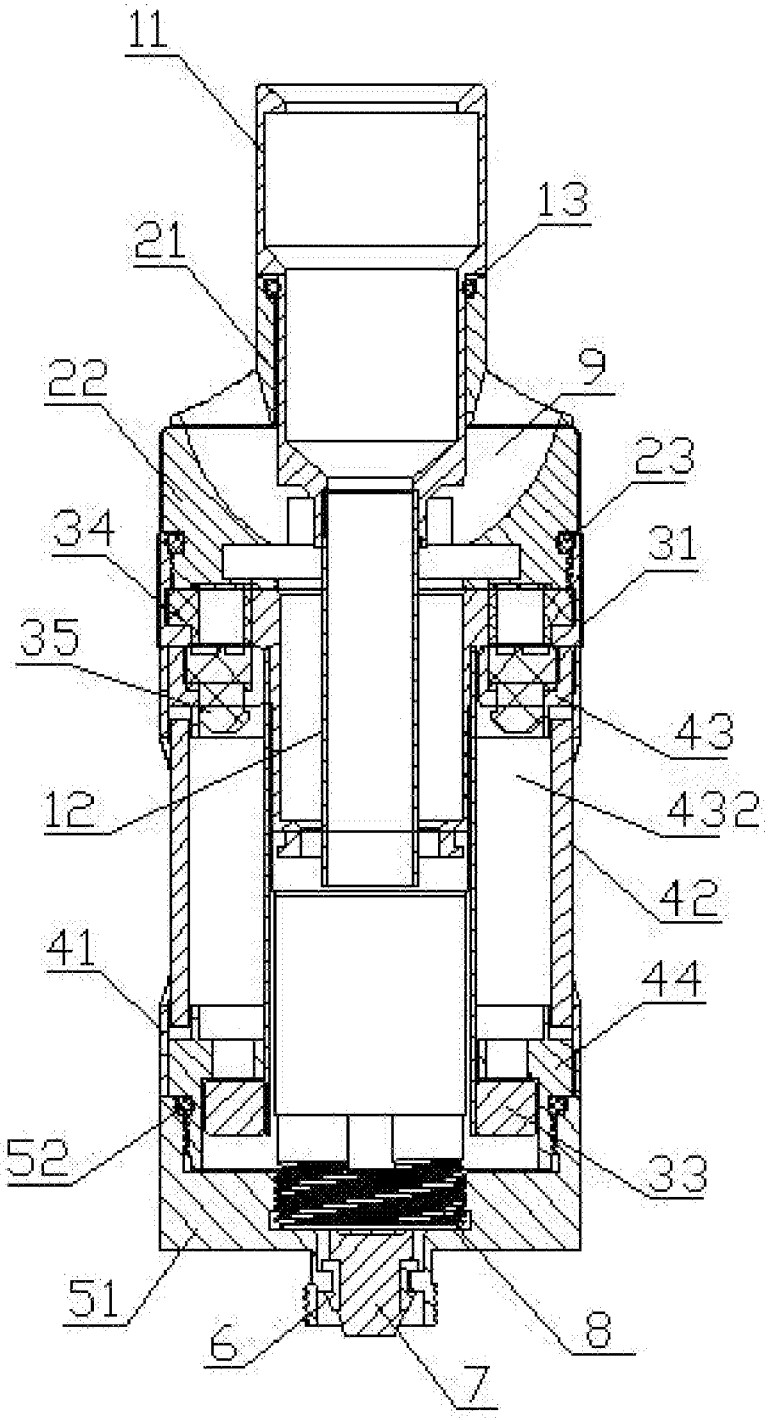
FIG. 3 is a cross sectional view of the atomizer of FIG. 1.

Referring to FIGS. 1-3, an atomizer is provided, which includes a mouthpiece assembly 1, an air adjusting assembly 2, a liquid adjusting assembly 3, a liquid storage assembly 4, a bottom seat assembly 5, an insulating ring 6, a pole contact member 7, and an atomizing head 8. The air adjusting assembly 2 is connected with and disposed at a bottom end of the mouthpiece assembly 1. The liquid adjusting assembly 3 is connected with and disposed at a bottom end of the air adjusting assembly 2. The liquid storage assembly 4 is connected with and disposed at a bottom end of the liquid adjusting assembly 3. The bottom seat assembly 5 is connected with and disposed at a bottom end of the liquid storage assembly 4. The insulating ring 6 is attached to the bottom seat assembly 5 and disposed at a bottom end of the bottom seat assembly 5. The pole contact member 7 is disposed in the insulating ring 6. The atomizing head 8 is located in the liquid storage assembly 4 and the bottom seat assembly 5. The atomizing head 8 is disposed at a top end of the pole contact member 7 and electrically connected with the pole contact member 7.

Figure 4:
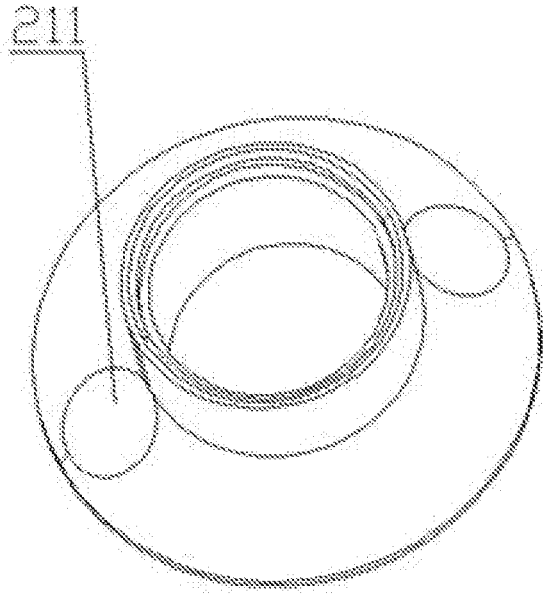
FIG. 4 is an isometric view of the air intaking hole in the embodiment of the present application.
Figure 5:
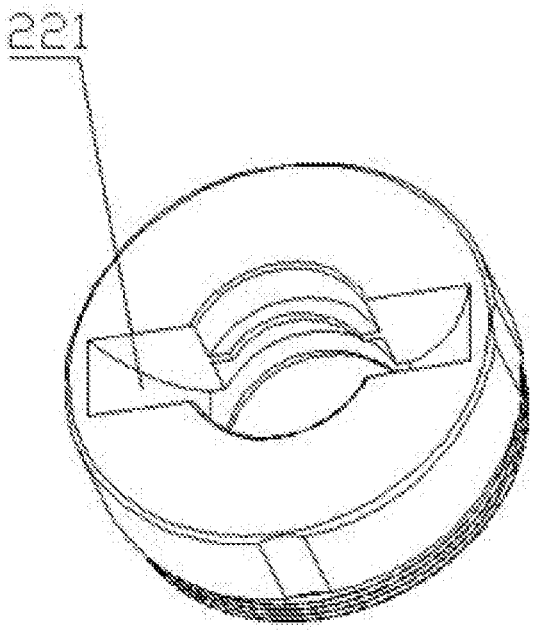
FIG. 5 is an isometric view of the air intaking slot in the embodiment of the present application.

The air adjusting assembly 2 includes an air adjusting ring 21 and an air adjusting seat 22. The air adjusting ring 21 is connected with the mouthpiece assembly 1. The air adjusting seat 22 is disposed at one end of the air adjusting ring 21 opposite to the mouthpiece assembly 1. One end of the mouthpiece assembly 1 passes through the air adjusting ring 21 and forms an interference fit with the air adjusting seat 22, so that the air adjusting ring 21 is fixed between the air adjusting seat 22 and the mouthpiece assembly 1. Referring further to FIG. 4 and FIG. 5, the air adjusting ring 21 is defined with at least one air intaking hole 211, and the air adjusting seat 22 is defined with at least one air intaking slot 221 corresponding to the air intaking hole 211. By rotating the air adjusting ring 21, the air intaking hole 211 and the air intaking slot 221 are caused to be communicated with each other or staggered from each other, to thereby adjust the amount of air intaking.

The mouthpiece assembly 1 includes a mouthpiece 11, a smoke discharging pipe 12, and a first sealing ring 13. One end of the mouthpiece 11 passes through the air adjusting ring 21 and forms an interference fit with the air adjusting seat 22. The smoke discharging pipe 12 is disposed below and connected with the mouthpiece 11. The first sealing ring 13 is disposed between the air adjusting ring 21 and the mouthpiece 11.

Figure 6:
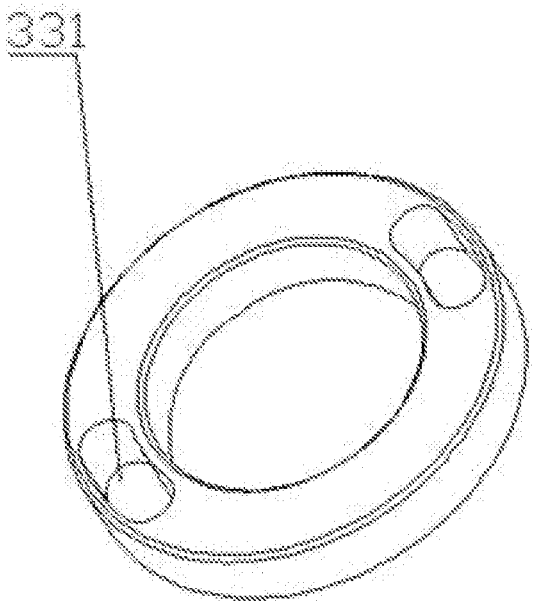
FIG. 6 is an isometric view of the first liquid intaking hole in the embodiment of the present application.
Figure 8:
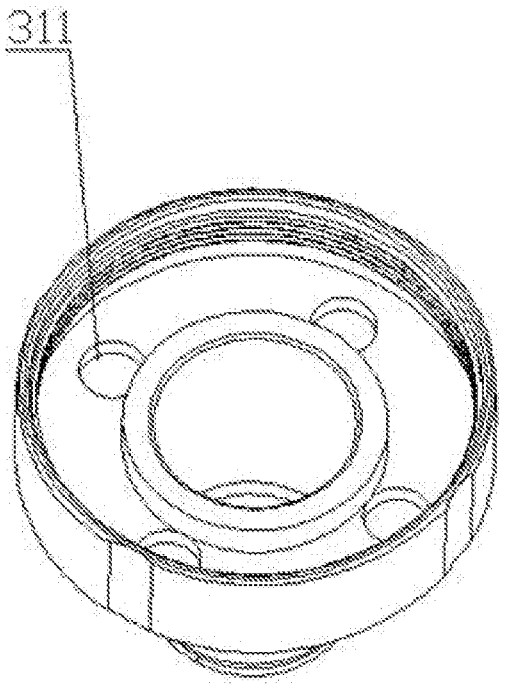
FIG. 8 is an isometric view of the first liquid injecting hole in the embodiment of the present application.

The liquid adjusting assembly 3 includes a liquid adjusting seat 31, an inner sleeve pipe 32, and a liquid barrier ring 33. The liquid adjusting seat 31 is threadedly connected with one end of the air adjusting seat 22 opposite to the air adjusting ring 21. The inner sleeve pipe 32 forms an interference fit with one end of the liquid adjusting seat 31 opposite to the air adjusting seat 22. The liquid barrier ring 33 forms an interference fit with one end of the inner sleeve pipe 32 opposite to the liquid adjusting seat 31. Referring further to FIG. 6 and FIG. 8, the liquid adjusting seat 31 is defined with at least one first liquid injecting hole 311, and the liquid barrier ring 33 is defined with at least one first liquid intaking hole 331.

Figure 7:
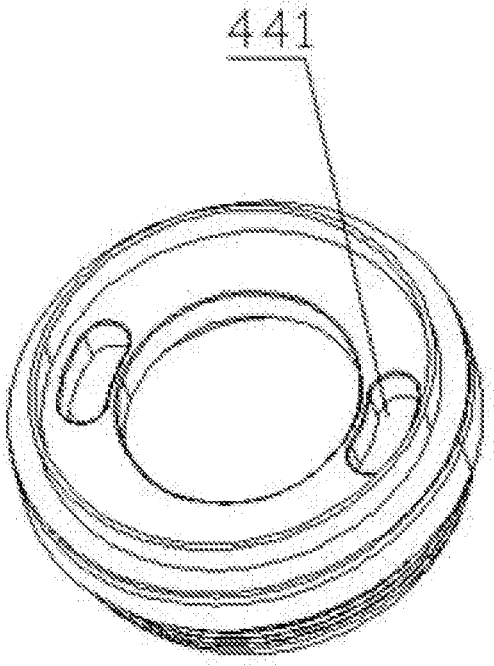
FIG. 7 is an isometric view of the second liquid intaking hole in the embodiment of the present application.
Figure 9:
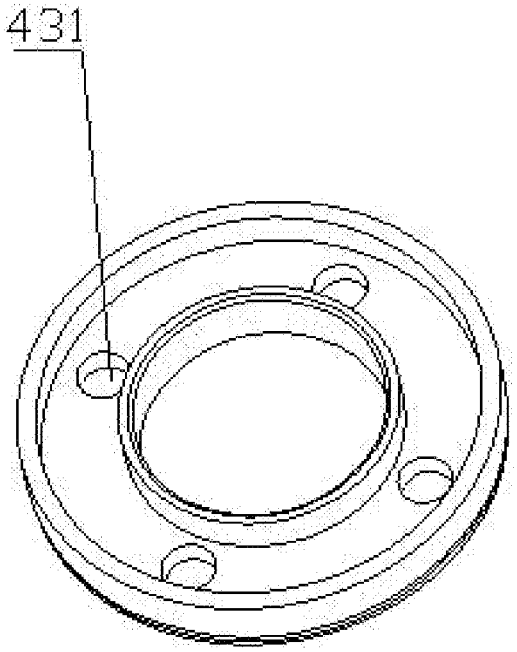
FIG. 9 is an isometric view of the second liquid injecting hole in the embodiment of the present application.

The liquid storage assembly 4 includes a liquid storage pipe 42, a fixing member 44, and a connecting member 43. The liquid storage pipe 42 is sleeved around the inner sleeve pipe 32. The fixing member 44 is disposed below the liquid barrier ring 33 and forms an interference fit with one end of the liquid storage pipe 42 opposite to the liquid adjusting seat 31. The connecting member 43 is sleeved on a top end of the inner sleeve pipe 32 and disposed between the liquid storage pipe 42 and the liquid adjusting seat 31. A liquid storage chamber 432 is defined in an annular space between the inner sleeve pipe 32 and the liquid storage pipe 42. Referring further to FIG. 7 and FIG. 9, the fixing member 44 is defined with at least one second liquid intaking hole 441, and the connecting member 43 is defined with at least one second liquid injecting hole 431. By rotating the liquid adjusting seat 31, the first liquid injecting hole 311 and the second liquid injecting hole 431 are caused to be aligned and communicated with each other, so that the user can add cigarette liquid. By rotating the liquid adjusting seat 31, the first liquid intaking hole 331 and the second liquid intaking hole 441 are caused to be communicated with each other or staggered from each other, to thereby adjust the amount of liquid intaking.

The liquid storage assembly 4 further includes an outer pipe 41 sleeved around the liquid storage pipe 42. The outer pipe 41 is defined with a window, for the user to acquire the residual amount of the cigarette liquid.

The liquid adjusting assembly 3 further includes a first sealing silicone pad 34 embedded in the liquid adjusting seat 31 and a second sealing silicone pad 35 embedded in the connecting member 43. The first sealing silicone pad 34 is defined with a third liquid injecting hole 341 communicated with the first liquid injecting hole 311, and the second sealing silicone pad 35 is defined with a fourth liquid injecting hole 351 communicated with the second liquid injecting hole 431.

The bottom seat assembly 5 includes a bottom cover 51 and a third sealing ring 52. The bottom cover 51 is threadedly connected with one end of the fixing member 44 opposite to the liquid storage pipe 42. The third sealing ring 52 is disposed between the fixing member 44 and the bottom cover 51.

The air adjusting assembly 2 further includes a second sealing ring 23 disposed between the air adjusting seat 22 and the liquid adjusting seat 31.

One end of the mouthpiece 11 is connected with the air adjusting seat 22 by an interference fit, and the air adjusting ring 21 is sleeved on the mouthpiece 11 and disposed between the mouthpiece 11 and the air adjusting seat 22. One end of the liquid adjusting seat 31 is threadedly connected with one end of the air adjusting seat 22 opposite to the air adjusting ring 21, and the other end of the liquid adjusting seat 31 is connected with one end of the inner sleeve pipe 32 by an interference fit. One end of the inner sleeve pipe 32 opposite to the liquid adjusting seat 31 is connected with the liquid barrier ring 33 by an interference fit. The inner sleeve pipe 32 is sleeved around the atomizing head 8. One end of the fixing member 44 opposite to the liquid storage pipe 42 is threadedly connected with the bottom cover 51. One end of the atomizing head 8 opposite to the smoke discharging pipe 12 is threadedly connected with the bottom cover 51.

When it is required to adjust the amount of air intaking, the air adjusting ring 21 is rotated to cause the air intaking hole 211 of the air adjusting ring 21 and the air intaking slot 221 of the air adjusting seat 22 to communicate with each other to form an air intaking passage 9. At this moment, the air intaking passage 9 is fully opened and has a maximal amount of air intaking. By adjusting the state of communication between the air intaking hole 211 and the air intaking slot 221, the air intaking passage 9 is opened or closed, to thereby control the amount of air intaking into the atomizer.

When it is required to add cigarette liquid, the mouthpiece 11, the air adjusting ring 21 and the air adjusting seat 22 which are fixed together, are detached to expose the first liquid injecting hole 311 of the liquid adjusting seat 31. The liquid adjusting seat 31 is rotated to cause the first liquid injecting hole 311 and the second liquid injecting hole 431 to communicate with each other, so that the cigarette liquid can be added into the liquid storage chamber 432, to realize liquid injection operation for the atomizer. At this moment, the first liquid intaking hole 331 and the second liquid intaking hole 441 are staggered from each other, to avoid liquid leakage.

When it is required to adjust the amount of the cigarette liquid flowing into the atomizing head 8, the liquid adjusting seat 31 is rotated, and the liquid barrier ring 33 is brought to rotate due to the connection of the inner sleeve pipe 32, to cause the first liquid intaking hole 331 and the second liquid intaking hole 441 to be communicated with each other or staggered from each other, so that the amount of the cigarette liquid flowing into the atomizing head 8 is adjusted, to realize liquid adjusting operation.

The present application further provides an electronic cigarette including the above atomizer.

In the present application, the air adjusting assembly 2 includes the air adjusting ring 21 and the air adjusting seat 22, so that the air intaking for the atomizer and the electronic cigarette can be adjusted. The liquid adjusting assembly 3 includes the liquid adjusting seat 31, the inner sleeve pipe 32 and the liquid barrier ring 33, so that the cigarette liquid can be added into the atomizer and the electronic cigarette. Further, by rotating the liquid adjusting seat 31, the amount of the cigarette liquid flowing into the atomizing head can be adjusted. The structure is simple, and the design is rational, with the integration of top air intake, top air adjusting, top liquid injection, and top liquid adjusting.

The above embodiment shows and describes the basic principles, main features, and the advantages of the present application, and should not be deemed as limitations to the scope of the present application. It should be noted that variations and improvements will become apparent to those skilled in the art to which the present application pertains without departing from its spirit. Therefore, the scope of the present application is defined by the appended claims.

INDUSTRIAL APPLICABILITY

The atomizer and the electronic cigarette of the present application have at least the following advantages, as compared with the prior art. The air adjusting assembly and the liquid adjusting assembly are disposed at the same end of the atomizer, to facilitate the operation for the user. The air adjusting assembly includes the air adjusting ring and the air adjusting seat, the air can enter into the atomizer. By rotating the air adjusting ring, the air intaking hole and the air intaking slot are communicated with each other, to open or close the air intaking passage, so that the air intaking into the atomizer can be adjusted, to control the amount of air intaking into the atomizer. The liquid adjusting assembly includes the liquid adjusting seat, the inner sleeve pipe and the liquid barrier ring, the cigarette liquid can be added into the atomizer. By rotating the liquid adjusting seat, the first liquid injecting hole and the second liquid injecting hole are communicated with each other, so that the cigarette liquid can be added into the liquid storage chamber. By rotating the liquid adjusting seat, the liquid barrier ring is brought to rotate due to the connection of the inner sleeve pipe, to cause the first liquid intaking hole and the second liquid intaking hole to be communicated with each other or staggered from each other, so that the amount of the cigarette liquid flowing into the atomizing head is adjusted, to realize liquid adjusting. The structure is simple, and the design is rational.

What is claimed is:

1. An atomizer comprising a liquid storage assembly, an air adjusting assembly and a liquid adjusting assembly, wherein the air adjusting assembly comprises an air adjusting ring and an air adjusting seat disposed at one end of the air adjusting ring, the liquid adjusting assembly comprises a liquid adjusting seat connecting with one end of the air adjusting seat opposite to the air adjusting ring, an inner sleeve pipe connecting with one end of the liquid adjusting seat opposite to the air adjusting seat, and a liquid barrier ring connecting with one end of the inner sleeve pipe opposite to the liquid adjusting seat, the liquid barrier ring is embedded in a fixing member in one end of the liquid storage assembly where the fixing member is defined with at least one second liquid intaking hole, the air adjusting ring is defined with at least one air intaking hole, the air adjusting seat is defined with at least one air intaking slot corresponding to the air intaking hole, when the air adjusting ring is rotated, an area of the air intaking hole communicated with the air intaking slot is adjusted, the liquid barrier ring is defined with at least one first liquid intaking hole corresponding to the second liquid intaking hole, when the liquid adjusting seat is rotated, the liquid barrier ring is brought to rotate by the inner sleeve pipe, to cause the first liquid intaking hole and the second liquid intaking hole to be communicated with each other or staggered from each other.

2. The atomizer of claim 1, wherein the liquid adjusting seat is defined with at least one first liquid injecting hole communicated with the liquid storage assembly.

3. The atomizer of claim 2, wherein the liquid storage assembly comprises a connecting member sleeved on a top end of the inner sleeve pipe and disposed at a bottom end of the liquid adjusting seat, the connecting member is defined with at least one second liquid injecting hole, when the liquid adjusting seat is rotated, the first liquid injecting hole and the second liquid injecting hole are caused to be aligned and communicated with each other.

4. The atomizer of claim 3, wherein the first liquid intaking hole and the second liquid intaking hole are staggered from each other when the first liquid injecting hole and the second liquid injecting hole are communicated with each other.

5. The atomizer of claim 3, wherein the liquid adjusting assembly further comprises a first sealing silicone pad embedded in the liquid adjusting seat and a second sealing silicone pad embedded in the connecting member.

6. The atomizer of claim 5, wherein the first sealing silicone pad is defined with a third liquid injecting hole communicated with the first liquid injecting hole, and the second sealing silicone pad is defined with a fourth liquid injecting hole communicated with the second liquid injecting hole.

7. The atomizer of claim 1, wherein the air adjusting assembly further comprises a second sealing ring disposed between the air adjusting seat and the liquid adjusting seat.

8. The atomizer of claim 1, wherein the atomizer further comprises a mouthpiece assembly, the mouthpiece assembly comprises a mouthpiece and a smoke discharging pipe, one end of the mouthpiece passes through the air adjusting ring and is connected with the air adjusting seat, the smoke discharging pipe is disposed below and connected with the mouthpiece.

9. The atomizer of claim 1, wherein one end of the liquid adjusting seat is threadedly connected with the air adjusting seat, the other end of the liquid adjusting seat is connected with one end of the inner sleeve pipe by an interference fit, one end of the inner sleeve pipe opposite to the liquid adjusting seat is connected with the liquid barrier ring by an interference fit.

10. An electronic cigarette comprising the atomizer of claim 1.

11. An atomizer comprising a liquid storage assembly and a liquid adjusting assembly, wherein the liquid adjusting assembly comprises a liquid adjusting seat, an inner sleeve pipe and a liquid barrier ring, the liquid adjusting seat is disposed at a top end of the liquid storage assembly, the liquid barrier ring is disposed at a bottom end of the liquid storage assembly, the inner sleeve pipe is disposed in the liquid storage assembly, a top end of the inner sleeve pipe is connected with the liquid adjusting seat, a bottom end of the inner sleeve pipe is connected with the liquid barrier ring, the bottom end of the liquid storage assembly is defined with a second liquid intaking hole, the liquid barrier ring is defined with a first liquid intaking hole corresponding to the second liquid intaking hole, when the liquid adjusting seat is rotated, the liquid barrier ring is brought to rotate by the inner sleeve pipe, to cause the first liquid intaking hole and the second liquid intaking hole to be communicated with each other or staggered from each other.

12. The atomizer of claim 11, wherein the liquid storage assembly comprises a liquid storage pipe and a fixing member, the liquid storage pipe is sleeved around the inner sleeve pipe, the liquid adjusting seat is disposed at a top end of the liquid storage pipe, the liquid barrier ring is disposed at a bottom end of the liquid storage pipe, the fixing member is disposed below the liquid barrier ring, the fixing member is connected with the bottom end of the liquid storage pipe by an interference fit, a liquid storage chamber is defined in an annular space between the inner sleeve pipe and the liquid storage pipe, the fixing member is defined with the second liquid intaking hole.

13. The atomizer of claim 12, wherein the liquid adjusting seat is defined with a first liquid injecting hole communicated with the liquid storage chamber.

14. The atomizer of claim 13, wherein the liquid storage assembly further comprises a connecting member, the connecting member is sleeved on the top end of the inner sleeve pipe, the connecting member is disposed between the liquid storage pipe and the liquid adjusting seat, the connecting member is defined with a second liquid injecting hole corresponding to the first liquid injecting hole, when the liquid adjusting seat is rotated, the first liquid injecting hole and the second liquid injecting hole are caused to be aligned and communicated with each other.

15. The atomizer of claim 14, wherein the first liquid intaking hole and the second liquid intaking hole are staggered from each other when the first liquid injecting hole and the second liquid injecting hole are communicated with each other.

16. The atomizer of claim 14, wherein the liquid adjusting assembly further comprises a first sealing silicone pad embedded in the liquid adjusting seat and a second sealing silicone pad embedded in the connecting member, the first sealing silicone pad is defined with a third liquid injecting hole communicated with the first liquid injecting hole, and the second sealing silicone pad is defined with a fourth liquid injecting hole communicated with the second liquid injecting hole.

17. The atomizer of claim 12, wherein the atomizer further comprises an air adjusting assembly, the air adjusting assembly comprises an air adjusting seat and an air adjusting ring, the air adjusting seat is connected with one end of the liquid adjusting seat opposite to the liquid storage pipe, the air adjusting ring is disposed at one end of the air adjusting seat opposite to the liquid adjusting seat, the air adjusting ring is defined with an air intaking hole, the air adjusting seat is defined with an air intaking slot corresponding to the air intaking hole, when the air adjusting ring is rotated, the air intaking hole and the air intaking slot are caused to be communicated with each other or staggered from each other.

18. The atomizer of claim 17, wherein the atomizer further comprises a mouthpiece assembly, the mouthpiece assembly comprises a mouthpiece and a smoke discharging pipe, one end of the mouthpiece passes through the air adjusting ring and is connected with the air adjusting seat, the smoke discharging pipe is disposed below and connected with the mouthpiece.

19. The atomizer of claim 12, wherein the atomizer further comprises a bottom seat assembly, an insulating ring, a pole contact member and an atomizing head, the inner sleeve pipe is sleeved around the atomizing head, the bottom seat assembly is disposed at the bottom end of the liquid storage assembly, the insulating ring is attached to the bottom seat assembly and disposed at a bottom end of the bottom seat assembly, the pole contact member is disposed in the insulating ring, the pole contact member is electrically connected with the atomizing head.

20. An electronic cigarette comprising the atomizer of claim 11.

* * * * *